US005425612A

United States Patent [19]

Ebstein

[11] Patent Number: 5,425,612

[45] Date of Patent: Jun. 20, 1995

[54] MECHANIZED AND AUTOMATICALLY MANAGED INSTALLATION FOR STORING OBJECTS SUCH AS CARS

[76] Inventor: Simon Ebstein, Pas de la Case, Andorre, France

[21] Appl. No.: 74,871

[22] PCT Filed: Dec. 10, 1991

[86] PCT No.: PCT/FR91/00967

§ 371 Date: Aug. 10, 1993

§ 102(e) Date: Aug. 10, 1993

[87] PCT Pub. No.: WO92/10628

PCT Pub. Date: Jun. 25, 1992

[30] Foreign Application Priority Data

Dec. 10, 1990 [FR] France ..... 90 15547

[51] Int. Cl.[6] ..... E04H 6/18

[52] U.S. Cl. ..... 414/254; 414/231; 414/264; 414/252; 414/260

[58] Field of Search ..... 414/227, 231, 232, 279, 414/234, 268, 235, 236, 237, 238, 239, 269, 240, 246, 252, 253, 254, 255, 259, 260, 261, 262, 264, 273; 364/478

[56] References Cited

U.S. PATENT DOCUMENTS

| | | | |
|---|---|---|---|
| 2,028,476 | 1/1936 | Rome et al. | 414/235 |
| 2,102,995 | 12/1937 | Coombs . | |
| 2,598,750 | 6/1952 | Bargehr | 414/262 X |
| 3,217,905 | 11/1965 | Frangos | 414/262 X |
| 3,390,791 | 7/1968 | Baldwin et al. | 414/237 X |
| 5,116,182 | 5/1992 | Lin | 414/254 |

FOREIGN PATENT DOCUMENTS

| | | | |
|---|---|---|---|
| 157733 | 7/1954 | Australia | 414/261 |
| 1566540 | 3/1968 | France . | |
| 2375411 | 12/1976 | France . | |
| 2509697 | 6/1982 | France . | |
| 2601989 | 6/1986 | France . | |
| 2608663 | 11/1986 | France . | |
| 2607175 | 4/1987 | France . | |
| 2656891 | 12/1989 | France . | |
| 187104 | 7/1989 | Japan | 414/232 |
| 505969 | 6/1969 | Switzerland . | |
| 1043371 | 9/1961 | United Kingdom . | |
| 954393 | 4/1964 | United Kingdom | 414/254 |

*Primary Examiner*—Frank E. Werner
*Attorney, Agent, or Firm*—Francis A. Sirr; Earl C. Hancock

[57] ABSTRACT

An automatic power-driven apparatus is provided for storing objects, particularly motor vehicles. The apparatus comprises at least two vertically-arranged levels, each having a closed-circuit transit track provided with two longitudinal transit lanes, four rows of storage cells extending on either side of each transit lane, and at least one lift which is movable between a loading and/or unloading bay and each level, each of the lifts being arranged so that it takes up the same space as a storage cell. The apparatus further comprises, on each level, at least one self-driving trolley, and a trolley-guiding device for moving the trolleys along the transit track, each trolley being provided with devices for loading and unloading the objects.

14 Claims, 18 Drawing Sheets

MECHANIZED AND AUTOMATICALLY MANAGED INSTALLATION FOR STORING OBJECTS SUCH AS CARS

This application a 371 of PCT/FR91/00967 filed Dec. 10, 1991.

BACKGROUND OF THE INVENTION

1. Field of the Invention

This invention relates to the field of mechanized and automatically managed installations for storing objects, such as cars.

2. Description of the Related Art

The related art teaches mechanized and automated parking arrangements in which unoccupied vehicles are transported from an entrance area to a storage cell and then, on request, the vehicles are transported to an exit area. Examples are described in the following French Patents: 2,608,663, 2,509,697, 2,607,175, 2,601,989, 2,256,891 and 2,375,411.

French Patent 1,566,540 is of interest in that it describes a parking installation having a number of fixed parking spots where vehicles are parked by their drivers. These parking spots are arranged in one or two rows along a traffic runway. Rotating parking platforms are placed in front of these parking spots. The installation allows rotation of the parking platforms to free the fixed parking spots when necessary.

French Patent 2,375,411 teaches a mechanized storage installation in which the axis of a vertical elevator shaft is perpendicular to the axis of horizontal traffic runways for trains of storage trolleys. The elevator comprises at least one guiding structure located outside of the horizontal traffic runways and a mobile set in pendulous motion along this vertical structure. The mobile set carries at least one retractable rack that is in an active position inside the traffic runways, and is in an inactive position outside the traffic runways. The rack is connected to the mobile set through a single line which transverses the horizontal traffic runways through passages in the traffic runways during active vertical motions of the rack.

Swiss Patent CH-505.969 teaches automatic parking for vehicles comprising a plurality of rectangular parking cells, and at least one mobile trolley for transporting the vehicles. Each cell is equipped along its longer sides with two series of bars for the support of vehicles wheels. These bars are placed at regular intervals and are smaller than the diameter of the vehicle wheels. Each series of bars makes up a comb whose teeth face the inside of the cell. The mobile trolley is equipped with two series of transport bars along its longitudinal axis placed at regular intervals equal to those of the support bars. Each series of transport bars comprise a comb whose teeth face the outside of the trolley. The mobile trolley is able to enter each cell, then move down so that the transport bars go through the support bars, and the wheels of the transported vehicle are laid on the support bars. Automatic parking is characterized in that the two series of support bars of each cell, as well as the two series of transport bars of the mobile trolley, are shifted by half an interval step.

In French Patent 2,607,175, a mechanized, fully-automated, parking facility is equipped with a system for lifting and transporting vehicles between an entrance area and an exit area of the parking facility having storage cells. A lifting and transporting system comprises a platform equipped with a support rack having a central structure, two series of horizontal support bars placed at intervals intermixed with support bars placed on the other side of the platform. Each storage cell comprises a fixed support rack which also features two series of fixed horizontal support bars protruding toward each other. The fixed bars of one of the two series are intermixed with the fixed bars of the other series, so as to allow the mobile rack to be in the same plane as the fixed rack, with the fixed and mobile bars in intermixed positions.

Great Britain Patent 1,043,371 describes storage cells perpendicular to the motion space of a transport elevator.

French Patent 2,509,697 describes a transport system for the parking of vehicles having two main identical close-shaped runways in approximately parallel planes. Two main synchronous belts extend along the two main runways. Two other similar close-shaped runways are provided in approximately parallel planes called "satellites", one of the two being contiguous to the main runways, but in between them according to their position. A plurality of spaced horizontal platforms are fixed to the main belts in between the main runways and near one of their extremities. Near the other extremity, the platforms are fixed to the satellites, inside and in between the satellite runways, the main and satellite runways longitudinally shifted having each a longitudinal section and transverse parts of change in direction in their respective shapes, such as they form first an acute angle, then the opposite acute angle with respect of the longitudinal sections, with vertical circulating in the area of change of direction for the platform circulating with the main belts, and auxiliary conveying belts adjacent the acute angle in the areas of change of direction of the satellite runways to engage a chain of the platforms when they enter that area, the length of the auxiliary belts always being sufficient to be in contact with at least two platforms so as to ensure horizontal stability when they circulate in an area of vertical motion.

None of the above parking systems presents the following advantages that are required from such systems: Unlimited capacity, very high ration volume/number of parking spots, very short cycles, and little on-site power.

SUMMARY OF THE INVENTION

The present invention is directed to fulfilling the need for a parking system which features the above-mentioned advantages.

To accomplish this, the present invention provides a mechanized and automatically-managed installation for storing objects, such as cars, characterized in that it comprises in combination: A close-shaped runway with two longitudinal traffic alleys; storage cells on both sides of each traffic alley so that two storage cells rows in between the traffic alleys are juxtaposed; at least one trolley, equipped with a stand-alone propelling means and guiding means, to allow the trolley to circulate along the runway, and respectively enter the storage cells, the trolley also being equipped with loading and unloading means to allow an object to be placed, or removed, from a storage cell; and a central managing unit capable of controlling the motion of each trolley and the loading and unloading means.

The installation is also characterized in that it comprises: At least two superimposed levels; at least one elevator travelling between a loading and/or unloading area at each level so as to serve the levels, each of the elevators being arranged so as to cover the area of one storage cell, and at least one central managing unit capable of controlling each elevator and each trolley and the loading and unloading means.

The installation is also characterized in that it comprises at least one close-shaped runway with two longitudinal traffic alleys wherein the storage cells are placed in herring-bone pattern from the longitudinal traffic alleys.

In another embodiment, the installation comprises at least two superimposed levels, each level comprising one close-shaped runway with two longitudinal traffic alleys; four rows of storage cells on both sides of each traffic alley so that two rows in between the alleys are juxtaposed; at least one elevator travelling between a loading and/or unloading area and each level so as to serve the levels, each of the elevators being arranged so as to cover the area of one storage cell; for each level, at least one trolley, equipped with stand-alone propelling means and guiding means to allow the trolley to circulate along the runway and reach each elevator and all storage cells, each of the trolleys being also equipped with loading and unloading means to allow an object to be placed in the storage cells and each elevator; and a central managing unit capable of controlling each elevator and each trolley and the loading and unloading means.

The ratio volume/number of parking spots of such an installation is high since the surface of each level used for storage is equal to, or greater than, two-thirds the total surface of the levels.

The vertical motion of the elevators and the horizontal motion of the trolleys are totally independent, which provides very short store-and-fetch cycles.

Each trolley uses its own propelling means. The on-site power is thereby reduced to a minimum. In another embodiment of the invention, the storage cells are placed in herring-bone pattern from the longitudinal traffic alleys; the guiding means of each trolley allows it to enter the storage cells and each elevator; and the loading and unloading means in each trolley allows placing an object when the trolley sits within a storage cell or an elevator.

This embodiment provides a simple means for loading and unloading; for example, not requiring any overhanging system which would otherwise be prejudicial to the stability of the trolley. Also, according to the preferred embodiment of the invention and particularly considering the loading and unloading means, each storage cell and elevator comprises two fixed longitudinal racks facing each other and each made of horizontal fixed parallel bars placed at intervals, the racks being arranged so as to leave a central empty space in between the tips of the fixed bars; each trolley comprises a frame on wheels with stand-alone propelling means; and the loading and unloading means comprises a mobile stand carried by the frame of the trolley, and comprising a central longitudinal structure of a width smaller than that of the central empty space between two fixed racks, and two series of horizontal, parallel bars placed at intervals perpendicular to, and on each side of, the central longitudinal structure; and means for vertically shifting the mobile stand, carried by the frame, when a trolley sits within a storage cell or an elevator, from a lower position where the mobile stand is underneath the plane of the fixed racks, to a higher position where it is above this plane.

The loading and unloading operations of the invention thus require only a small vertical shift of the mobile stand, preferably provided by two vertical jacks fixed on the frame of the trolley.

In yet another embodiment of the invention, each elevator comprises a mobile floor-board equipped with openings for receiving the horizontal bars of the fixed racks, and means for vertically shifting the floor-board between a high position, where it is in the same plane as that of the racks, and a low position where it is hidden under the racks so as to align with the runway of the served level.

Thus, when a vehicle is guided within an elevator, the floor-board is in the higher position and passengers can get down off the vehicle to a floor. Thereafter, the floor-board is set in its lower position where it allows the trolley to enter the elevator so as to be picked up.

In yet another embodiment of the invention, each trolley comprises four wheels joined two-by-two by two axles through pivots; the guiding means of the trolley comprises a main guiding groove longitudinally in the runways and for each of the trolleys, two guiding rollers fitting and sliding within the main groove, each roller actuating the pivots of two wheels joined by the same axle through steering tie rods.

Moreover, in a preferred embodiment of the invention, the installation comprises secondary guiding grooves intersecting with the main guiding groove to allow the trolleys to enter the storage cells and elevators, and switching means being placed at each intersection. Moreover, the switching means comprises a piston placed horizontally in a cavity of the runway opening in the main guiding groove, the piston comprising a rod with a switching shoe having a front face shaped for guiding the troller toward a secondary guiding groove, and featuring two states: A drawn-in state when the shoe is out of the main guiding groove, and a spread-out state when the shoe resides within the main groove.

Other characteristics, goals and advantages of the invention will be apparent from the following detailed description with reference to the drawing giving a preferred embodiment which is not to be interpreted in a limited sense.

DESCRIPTION OF THE PREFERRED EMBODIMENT(S)

Figure 1:
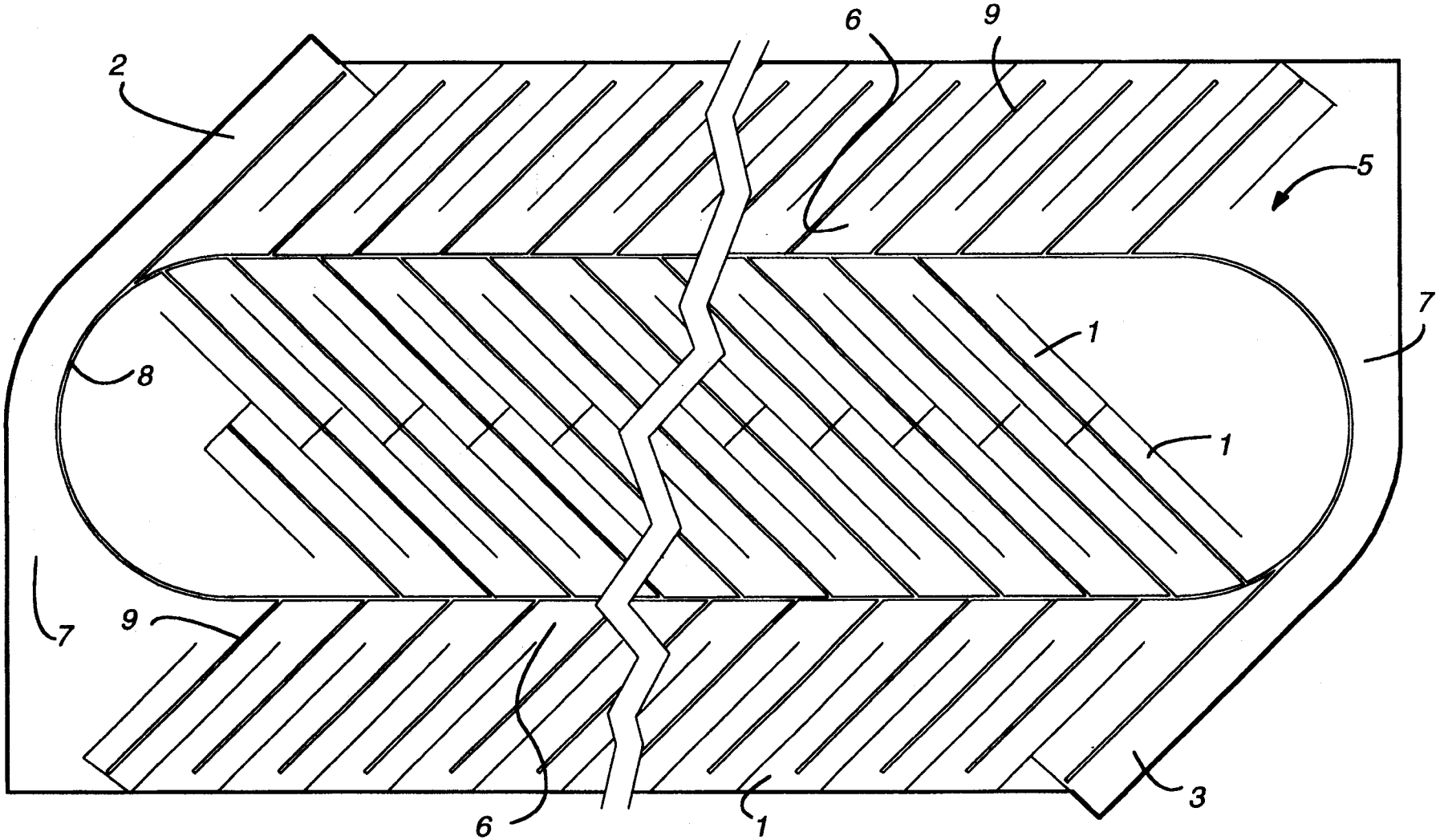
FIG. 1 is a view of one level of a parking installation according to the invention.
Figure 6:
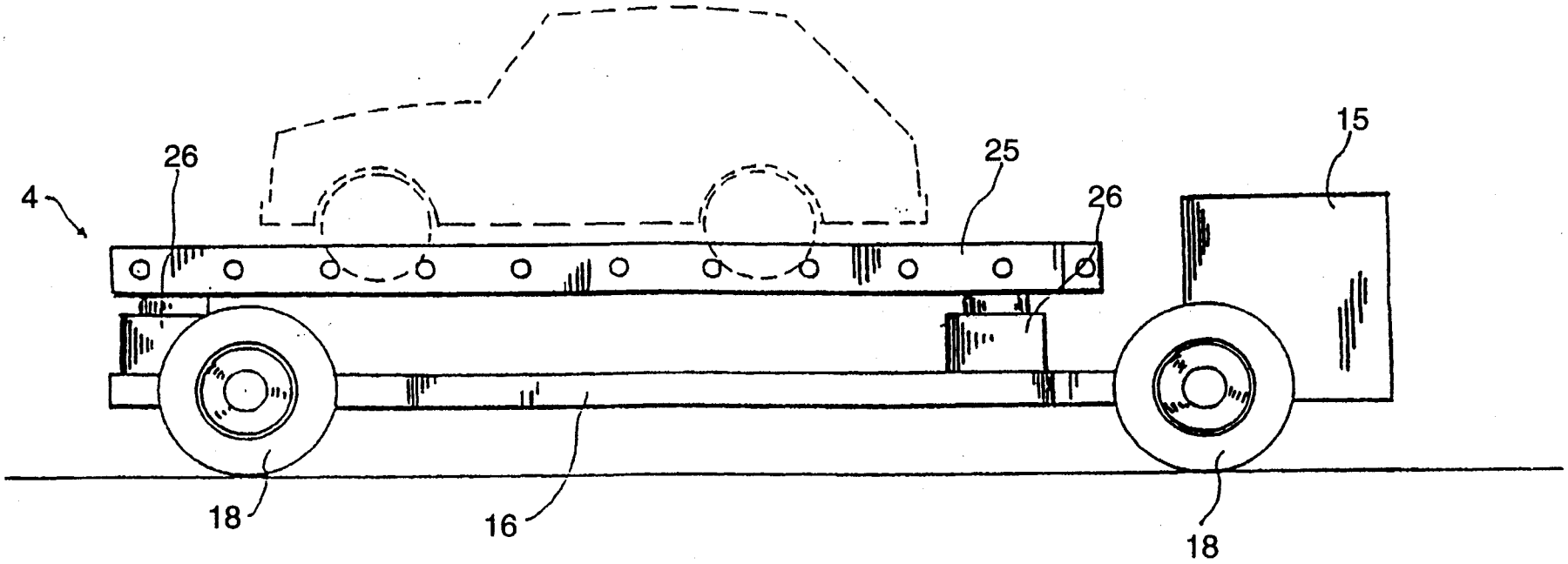
FIG. 6 is a side view of a trolley according to the invention.
Figure 7:
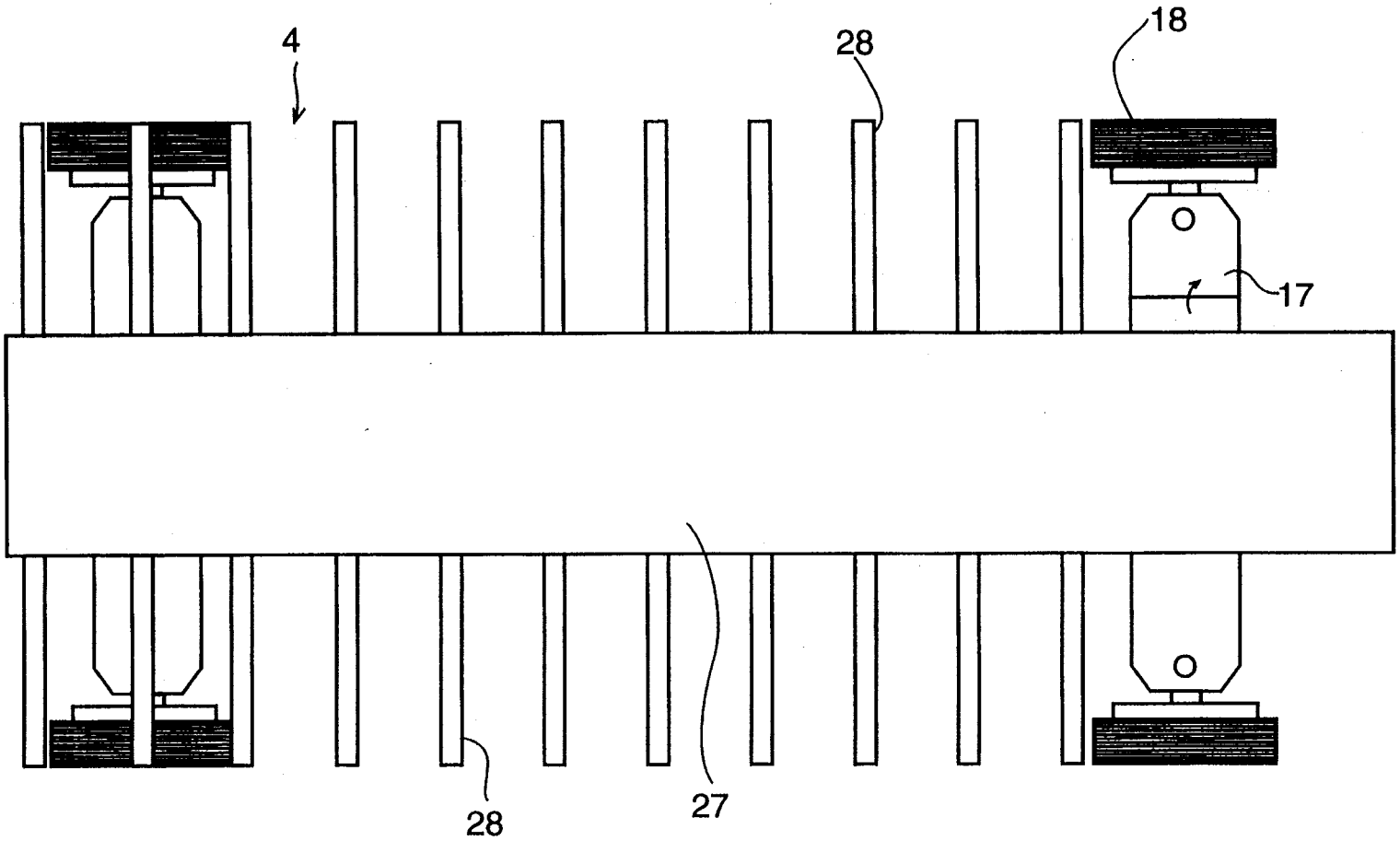
FIG. 7 is a top view of the trolley.

The invention, as presented in the drawings, consists of a mechanized and fully automatically-managed parking facility. This parking facility comprises several superimposed levels, one level of which is shown in FIG. 1, and each comprising a plurality of storage cells 1, an elevator 2 for the transporting of vehicles from an entrance area for the levels, and an elevator 3 for transporting the vehicles from the level to an exit area. Moreover, this parking facility comprises, for each level, at least one trolley 4 (FIG. 6) for transporting vehicles between elevators 2, 3 and storage cells 1.

Each level features a close-shaped runway 5 comprising two longitudinal traffic alleys 6 whose extremities meet at semi-circular traffic alleys 7.

Each level comprises four rows of storage cells 1, on both sides of the traffic alleys 6, the two rows in between alleys 6 extending from each other, and the storage cells 1 being placed in herring-bone pattern from each side of a longitudinal traffic alley 6.

Moreover, storage cells 1, on both sides of each longitudinal traffic alley 6, are shifted from each other by a length of half the width of one storage cell.

Two storage cell areas (for example, for two cells at opposite ends) coincide with the vertical shafts of elevators 2, 3.

Runway 5 is equipped with a main guiding groove 8 which intersects on both sides at each storage cell 1 level. Secondary guiding grooves 9 extend within storage cells 1.

Figure 2:
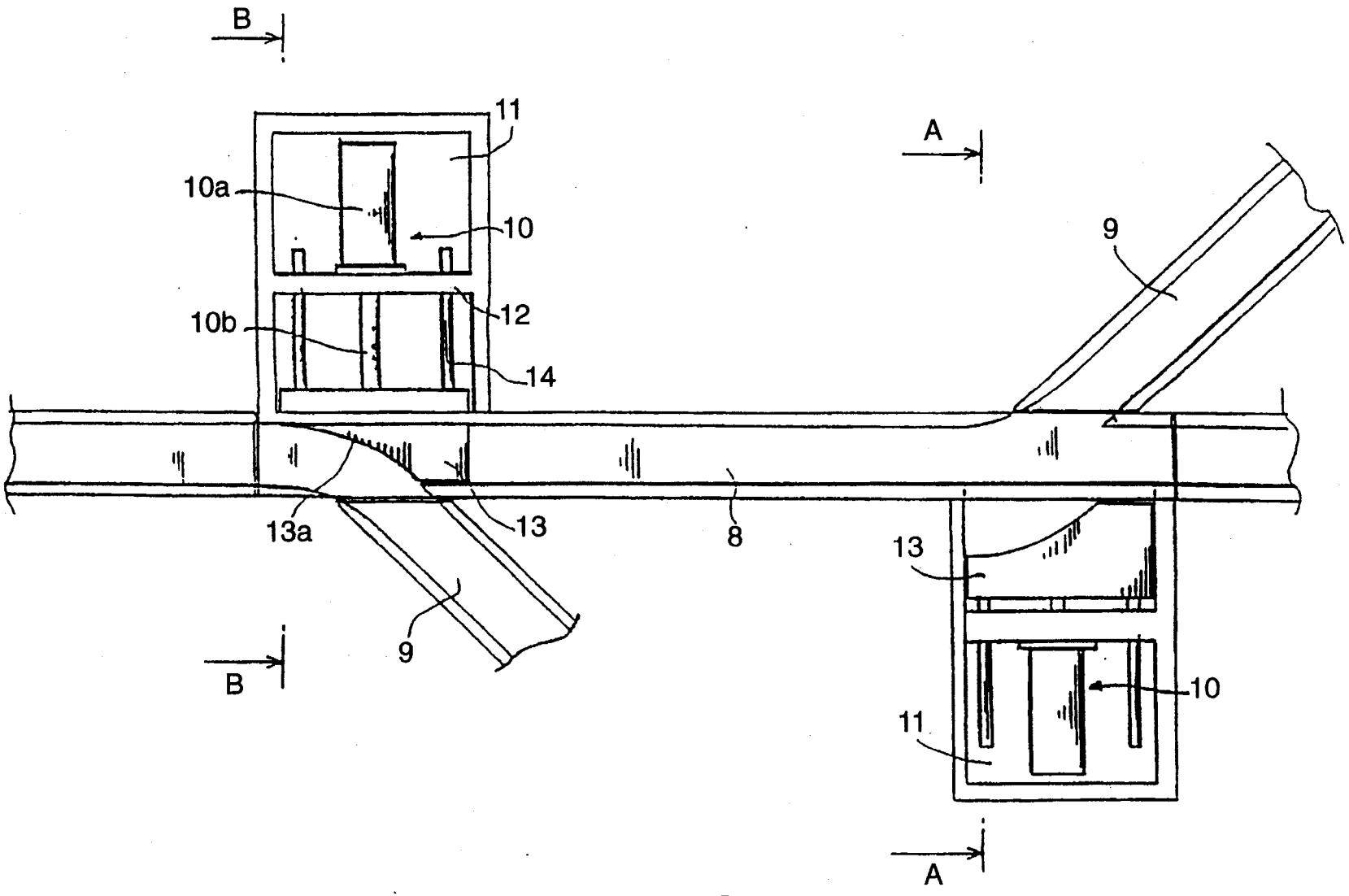
FIG. 2 is a partial plan view of the grooves guiding the trolleys in such an installation, and two switching means in an active and passive position, respectively.
Figure 3:
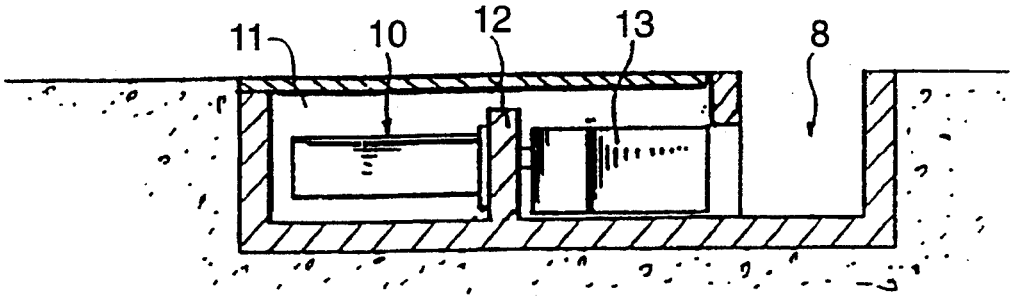
FIG. 3 is a cross-sectional view in the vertical plane A of the guiding groove of FIG. 2 showing a switching means in the passive position.
Figure 4:
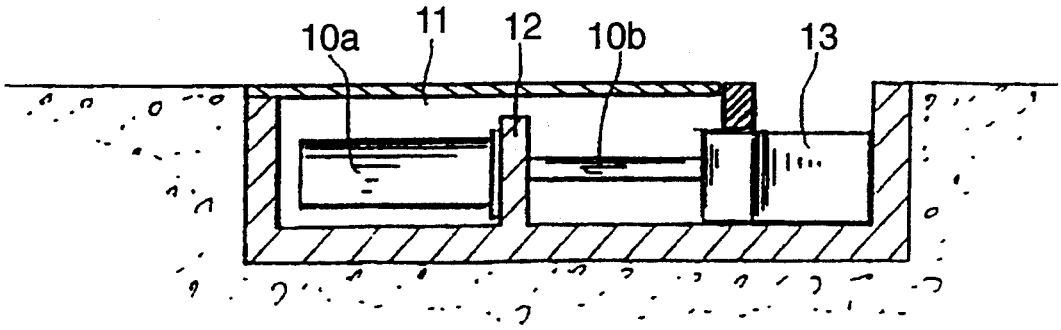
FIG. 4 is a cross-sectional view in the vertical plane B of the guiding groove of FIG. 2 showing a switching means in the active position.

As shown in FIG. 2, there is a switching device at each intersection between main guiding groove 8 and each secondary guiding groove 9. Each switching device comprises a piston 10, sitting in a cavity 11 of runway 5, and opening into main guiding groove 8 at an intersection with a secondary guiding groove 9.

Pistons 10 are horizontal and extend perpendicularly from main guiding groove 8. Piston body 10A is fixed onto transverse wall 12 of each cavity 11, whereas piston rod 10B carries a guided switching shoe 13. When piston rod 10 is actuated, two guiding rods 14 that are fixed to shoe 33 are able to slide through transverse wall 12.

Each of shoes 13 features a front face 13A of concave shape for linking main guiding groove 8 with a corresponding secondary guiding groove 9 when shoe 13 is positioned inside the main guiding groove 8. Each piston 10 features two states: A drawn-in state when shoe 13 sits in cavity 11 outside main guiding groove 8, and a spread-out state when shoe 13 resides within main guiding groove 8.

The main 8 and secondary 9 guiding grooves and the switching devices allow a trolley 4 to be guided when moving along runway 5, and otherwise enter storage cells 1 and elevators 2, 3 for the loading, or unloading, of a vehicle.

There are preferably two trolleys, four per level, each equipped with stand-alone propelling means 15 (FIG. 6) allowing forward or backward motion of the trolley, such as electrical batteries, one trolley being charged with power and another troller being on duty.

As seen in FIGS. 6 to 11, each trolley 4 comprises a frame 16 mounted on two axles 17 each axle carrying two wheels 18 through pivots 19.

Figure 5:
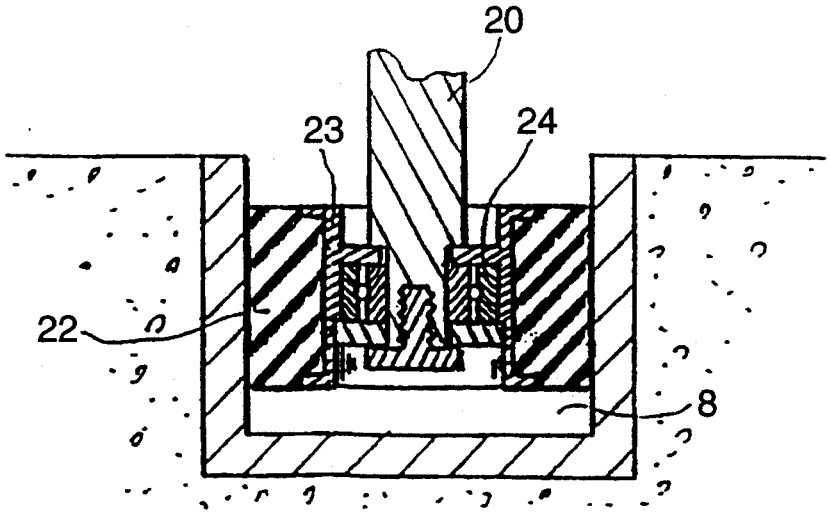
FIG. 5 is a transverse view in section of the guiding groove showing a guiding roller mounted on each trolley.
Figure 8:
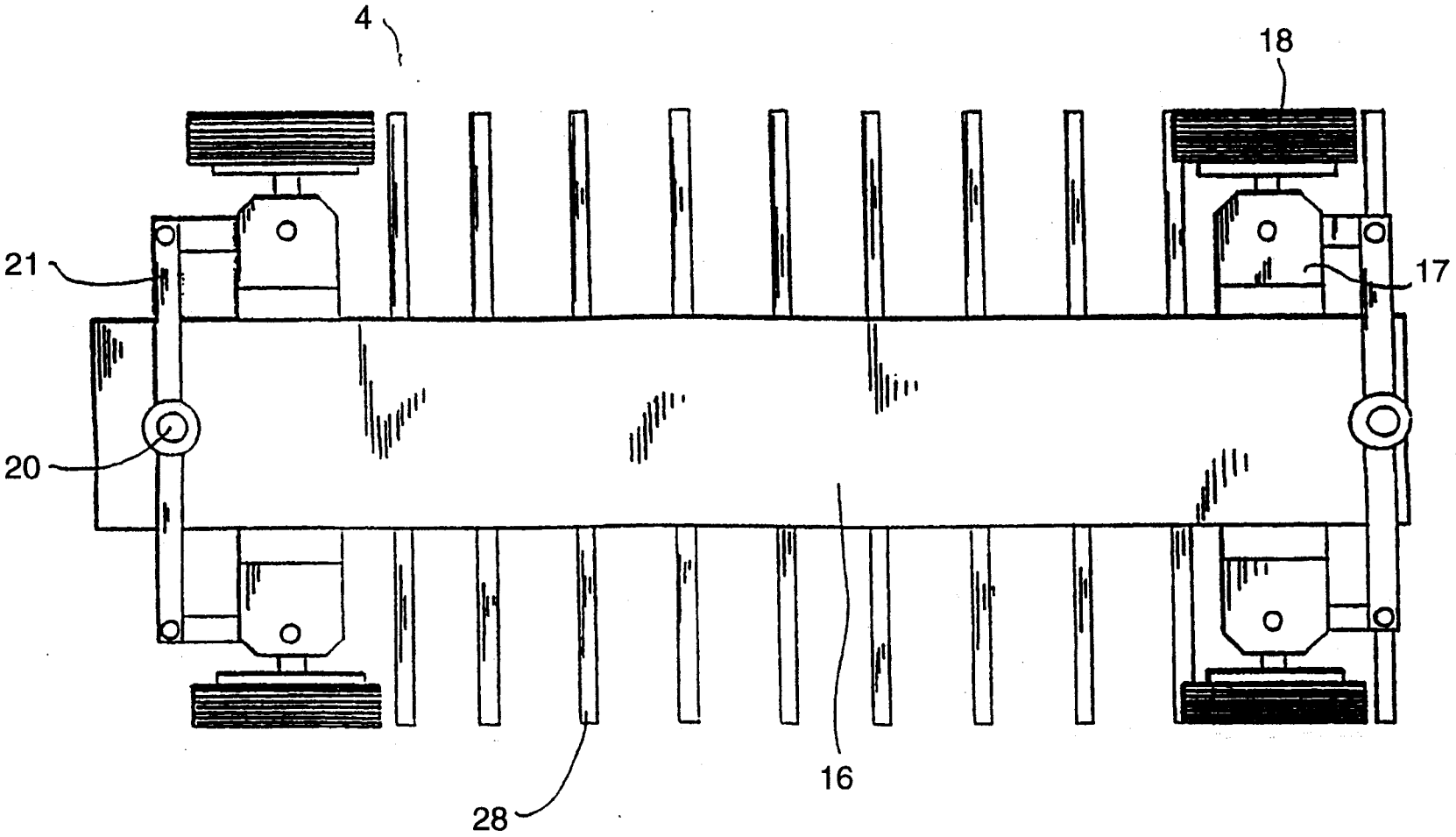
FIG. 8 is a bottom view of the trolley.
Figure 9:
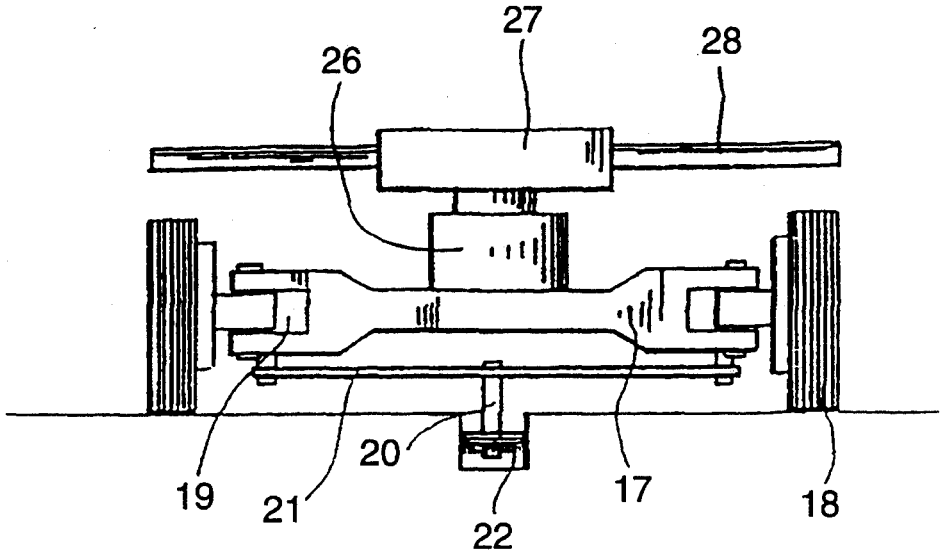
FIG. 9 is a front view of the trolley in a lower position.
Figure 10:
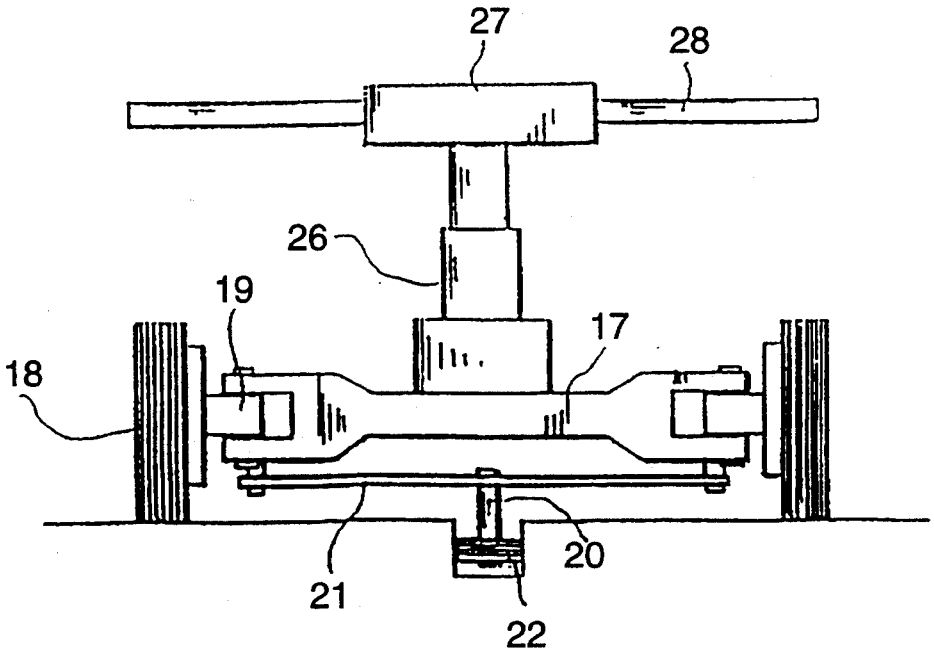
FIG. 10 is a front view of the trolley in a higher position.
Figure 11:
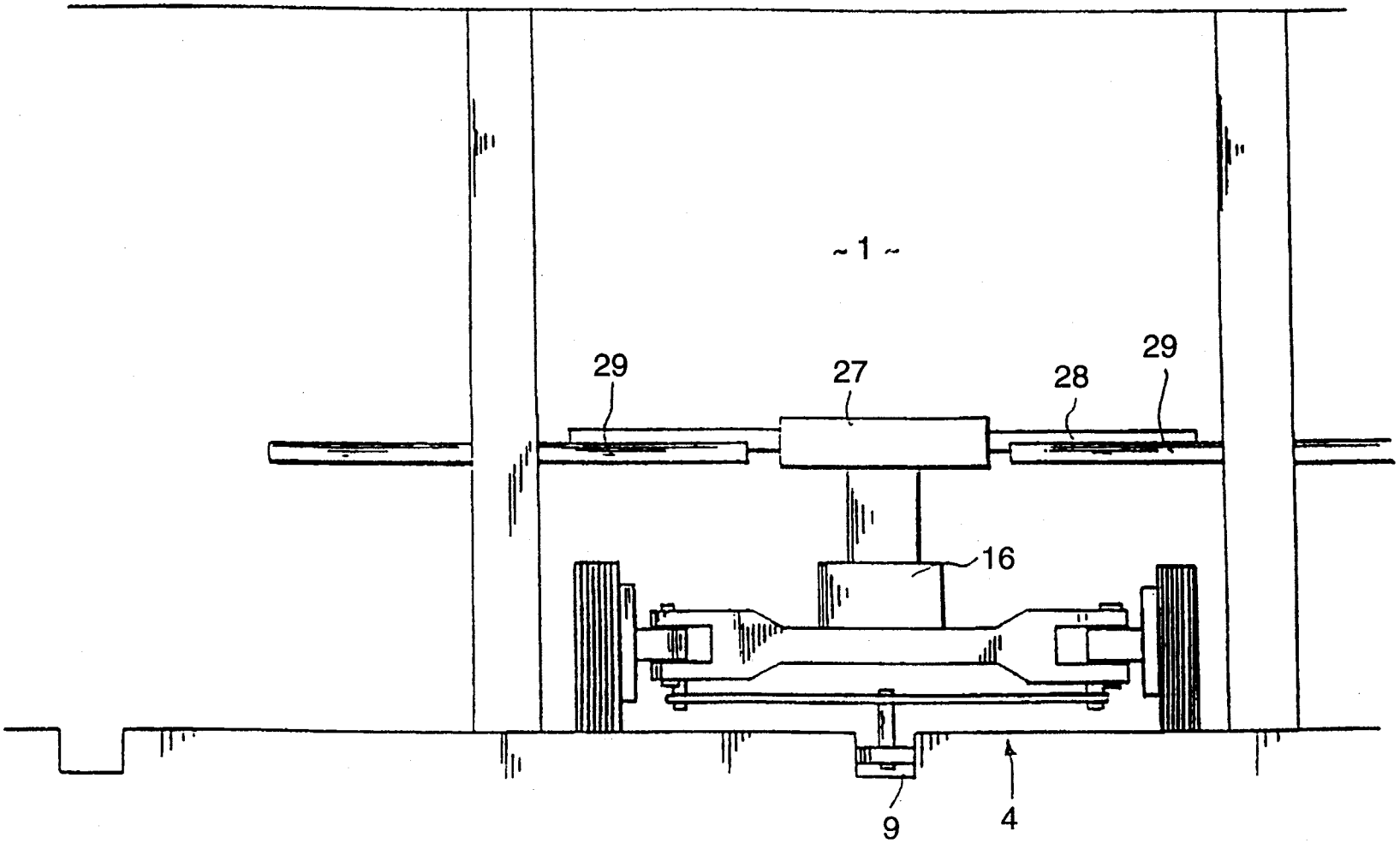
FIG. 11 is a front view of a storage cell with a trolley in the higher position.

Each of the trolleys 4 also comprises for each axle 17, a vertical steering shaft 20 connected to pivots 19 through steering tie rods 21 (FIG. 8). Shaft 20 carries a rubber roller 22 for horizontal guiding, roller 22 fitting and sliding in guiding grooves 8, 9. Roller 22 is mounted on a rim 23 around ball bearing 24 on vertical steering shaft 20 (FIG. 5).

Each trolley 4 includes a mobile stand 25 carried by two jacks 26 vertically mounted on frame 16. Mobile stand 25 is made of a central longitudinal structure 27 and two series of horizontally parallel bars 28 placed at intervals and extending perpendicularly from both sides of central structure 27.

Each storage cell 1 and each elevator 2, 3, comprise two fixed longitudinal racks 29 (FIGS. 12 and 13) facing each other, and each made up of horizontal fixed parallel bars placed at intervals. Racks 29 are arranged so as to leave in between the tips of the bars, a central empty space of a width larger than that of the central structure 27 of trolleys 4.

Figure 12:
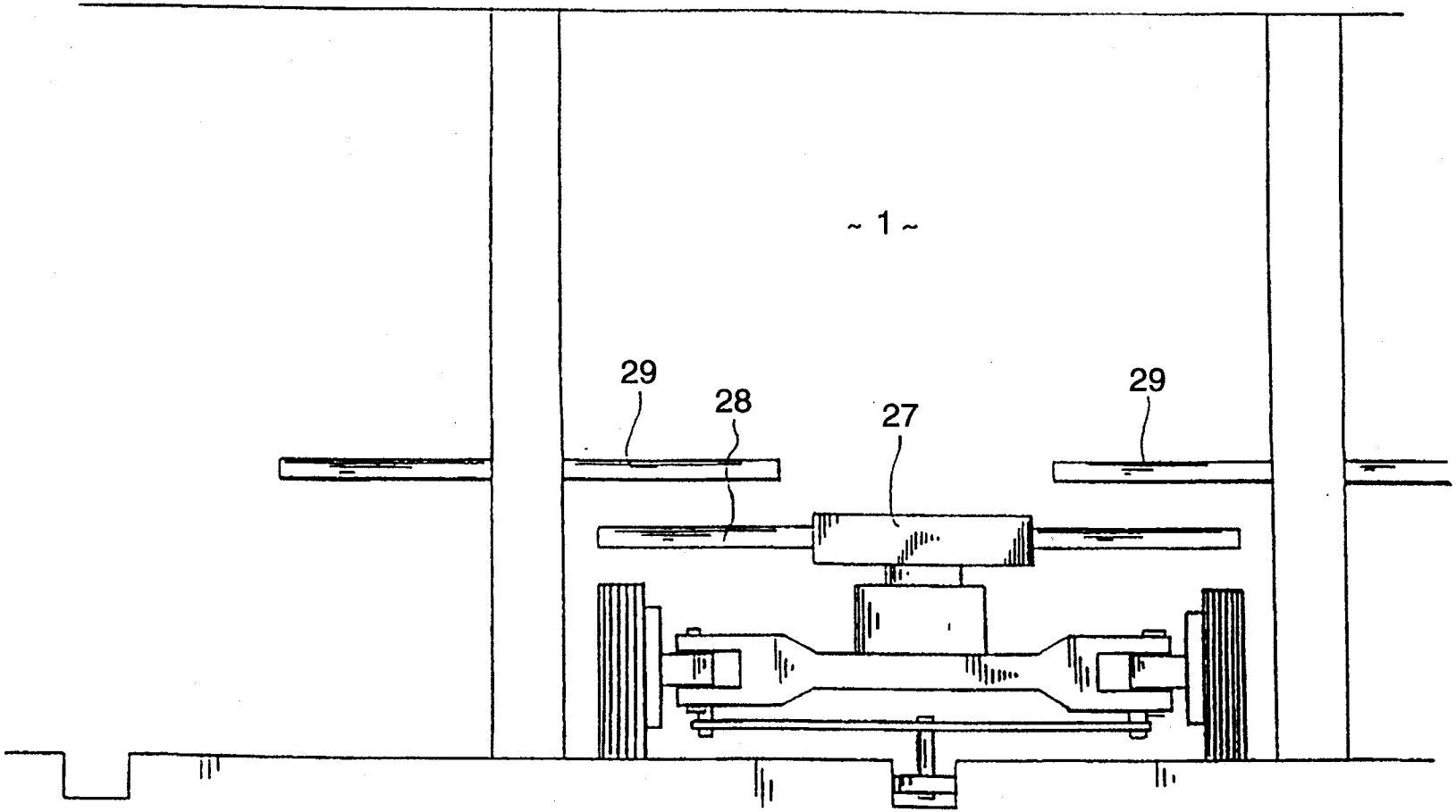
FIG. 12 is a front view of a storage cell with a trolley in the lower position.
Figure 13:
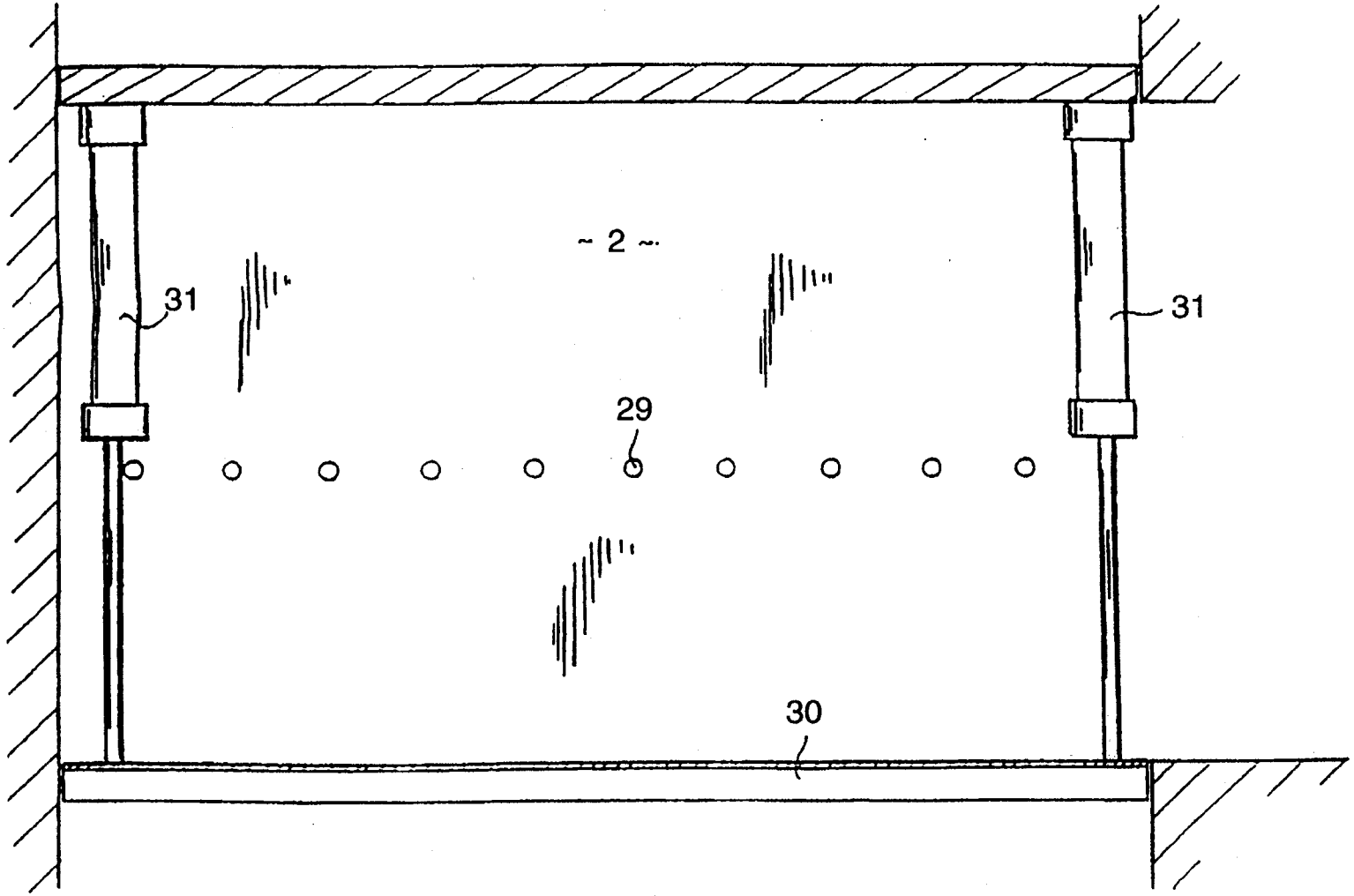
FIG. 13 is a side view of an elevator according to the invention.

Racks 29 are also arranged so as to define a horizontal support plane extending underneath bars 28 of trolleys 4, in the higher position of mobile stand 25 (FIG. 11), and above bars 28 in the lower position of mobile stand 25 (FIG. 12).

Each elevator 2, 3 comprises a mobile floor-board 30 (FIG. 13) featuring openings to receive the horizontal bars of the fixed racks 29 of an elevator.

Mobile floor-board 30 is carried by four vertical jacks 31, and can be shifted from a higher position where it is in the same horizontal plane as that of racks 29, and a lower position where it is hidden under racks 29 so as to align with runway 5 of the served level.

Mobile floor-board 30 is also equipped with a guiding groove (not shown) which forms an extension of a secondary guiding groove 9 at each served level.

When an elevator 2, 3 is at a level entrance or exit area, mobile floor-board 30 is in its higher position allowing passengers to walk on a floor when they get out or on board a vehicle.

Mobile floor-board 30 is then retracted to the lower position. This allows trolleys 4 to enter elevator 2, 3 for the loading or unloading of a vehicle.

To facilitate the centering of a vehicle when introduced into an elevator at an entrance area, the latter can be equipped with rollers having vertical, or inclined, axis so as to provide lateral guidance of the vehicle.

Lastly, the installation is equipped with detection means, such as emitting-receiving cells for stopping a trolley 4 once it has passed an intersection corresponding to the storage cell selected by a central managing unit, and stopping a trolley 4 once it has entered a storage cell 1 or an elevator 2, 3.

All the devices and mechanisms described above are actuated for the automated running of the parking installation by a central managing unit programmed to allow the following organization of vehicle parking. When a vehicle reaches an entrance area, mobile floor-board 30 is in the higher position which allows the driver to drive the vehicle into an elevator 2, 3 and get out of a floor. Once the driver has left an elevator 2, 3, the doors of the latter (not shown) are locked. An automatic dispenser allows the driver to obtain a ticket on which is indicated the level and the vehicle storage cell selected by the central managing unit. The elevator 2, 3 then moves to the selected level, the mobile floor-board 30 being at the same time lowered so as to lay the vehicle on fixed racks 29. Simultaneously, trolley 4 of the selected level is stopped in front of the elevator, as a result of a corresponding emitting-receiving cell.

Once the elevator is at the selected level, trolley 4 backs up, as a result of the operation of guiding piston 10 corresponding to the intersection leading to this elevator.

Mobile stand 25 is then lifted up so that its bars 28 go though racks 29. The vehicle is from then on lifted by a trolley 4 which circulates along runway 5, the mobile stand 25 staying in the higher position and not changing to its lower position until the trolley is stopped by the emitting-receiving cell corresponding to the selected parking spot.

Guiding piston 10 corresponding to this parking spot, or cell, is then actuated and trolley 4 backs up until it is stopped by the emitting-receiving cell which is placed at the back of the storage cell 1.

Jacks 26 are then retracted and the vehicle is placed on racks 29. Once done, trolley 4 is moved back onto runway 5, along which runway the trolley circulates until it is stopped by an activated emitting-receiving cell. Depending on the case, this stopping of a trolley 4 takes place either in front of an elevator 2, 3, if a new vehicle is being driven in, or in front of a storage cell 1 if a driver needs his vehicle fetched.

In the second case, the driver only needs to introduce the ticket previously given to him in an electronic reader that is located at the exit area. The exit cycle consists of setting a trolley 4 of the corresponding level in front of the selected parking spot or cell, as indicated above, and commanding the descent of exit elevator 2, 3. The following steps are then reversed, those steps corresponding to the entrance of a vehicle.

Figure 14:
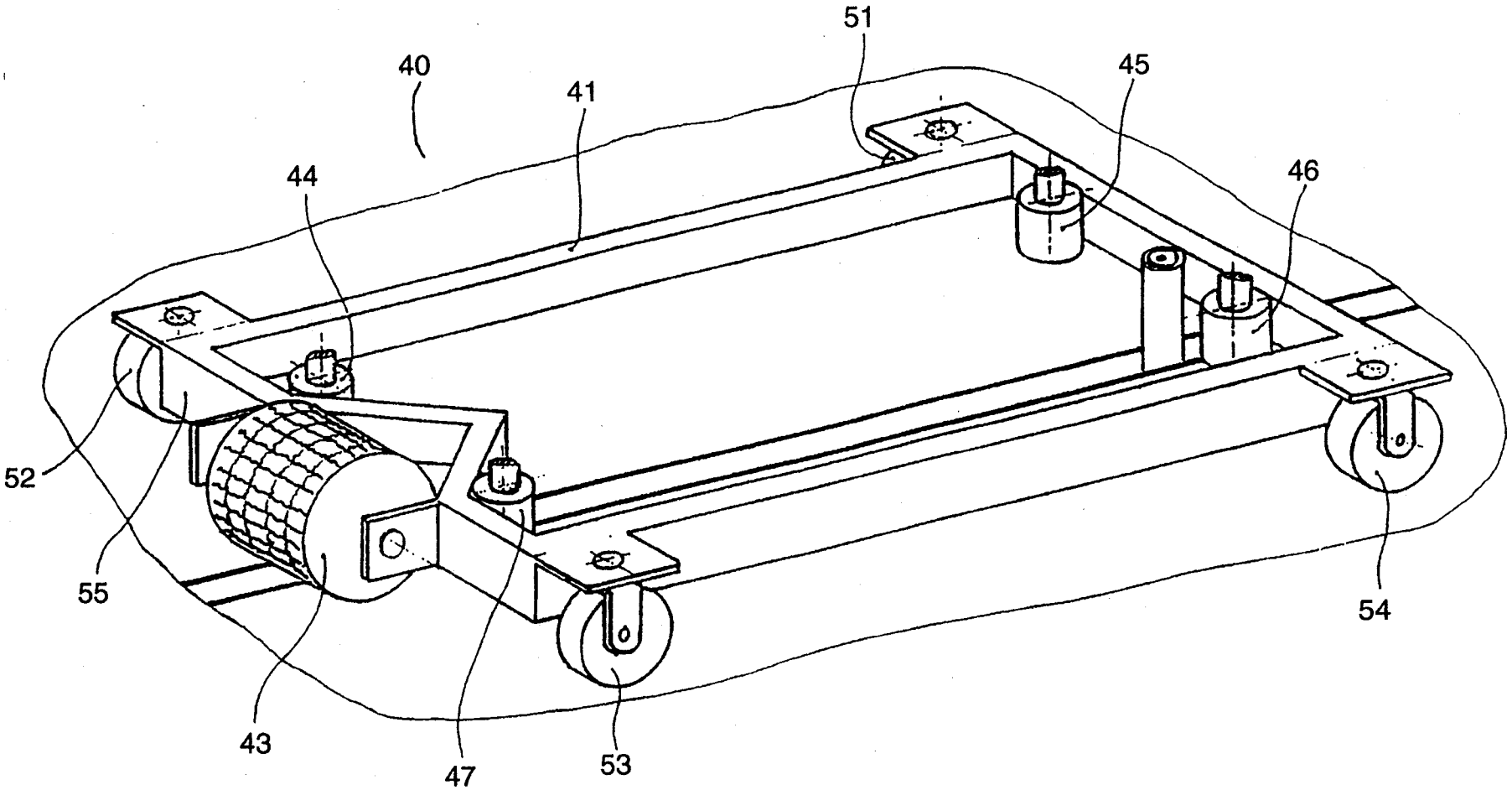
FIG. 14 is a perspective view of another embodiment of a trolley according to the invention showing the bottom part of the trolley.
Figure 15:
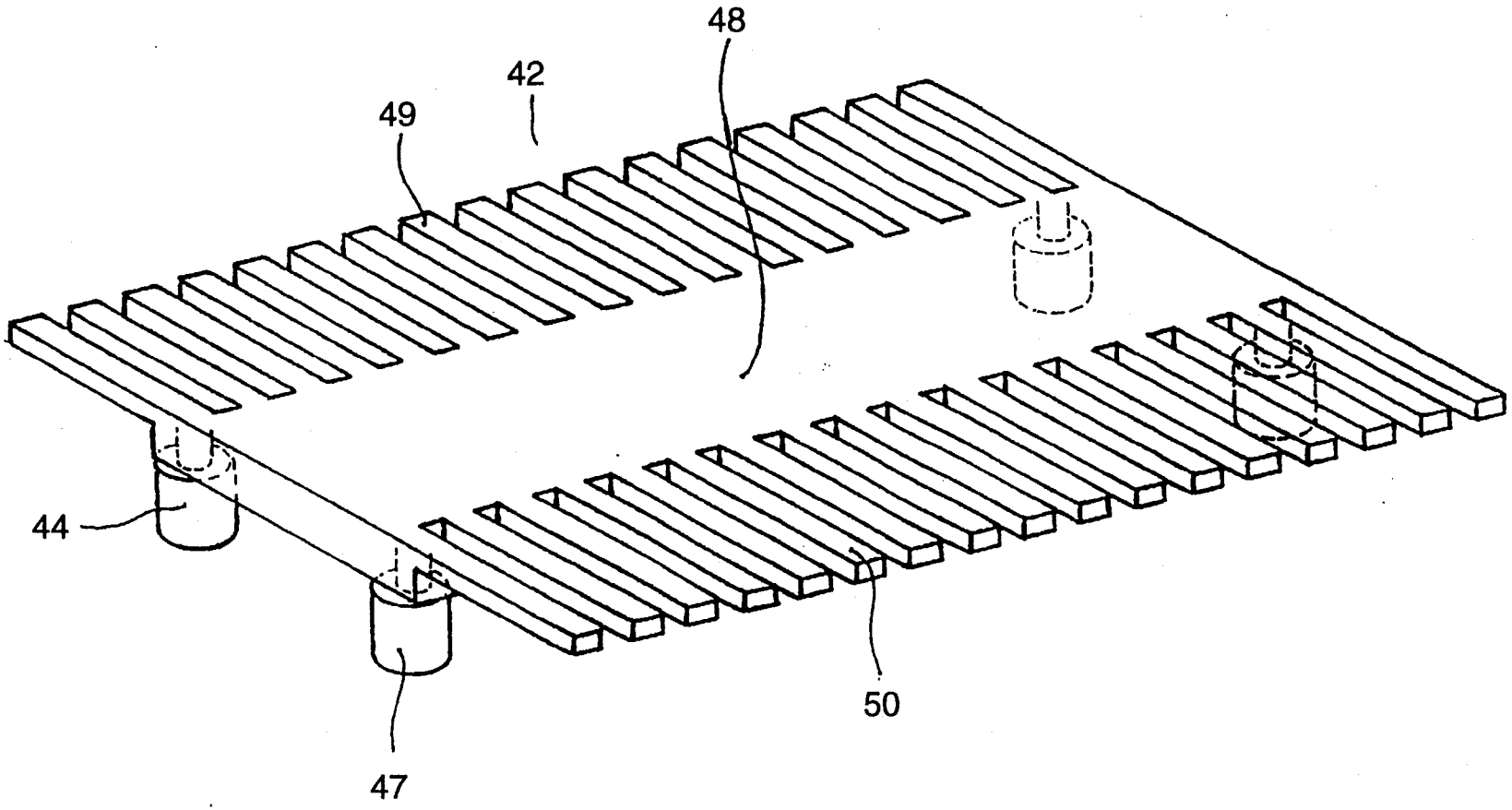
FIG. 15 is a perspective view of the trolley of FIG. 14 showing the top mobile part which can be actuated by jacks.
Figure 16:
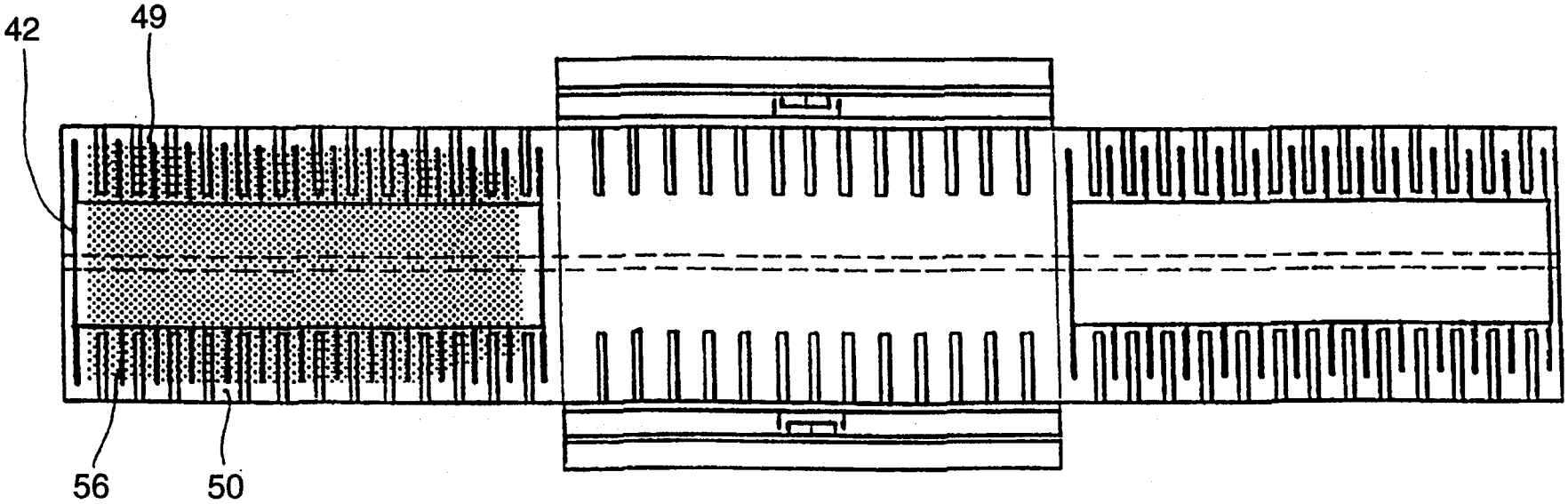
FIG. 16 is a plan view of the loading and unloading area of a vehicle by a trolley and the loading on board the elevator.
Figure 17:
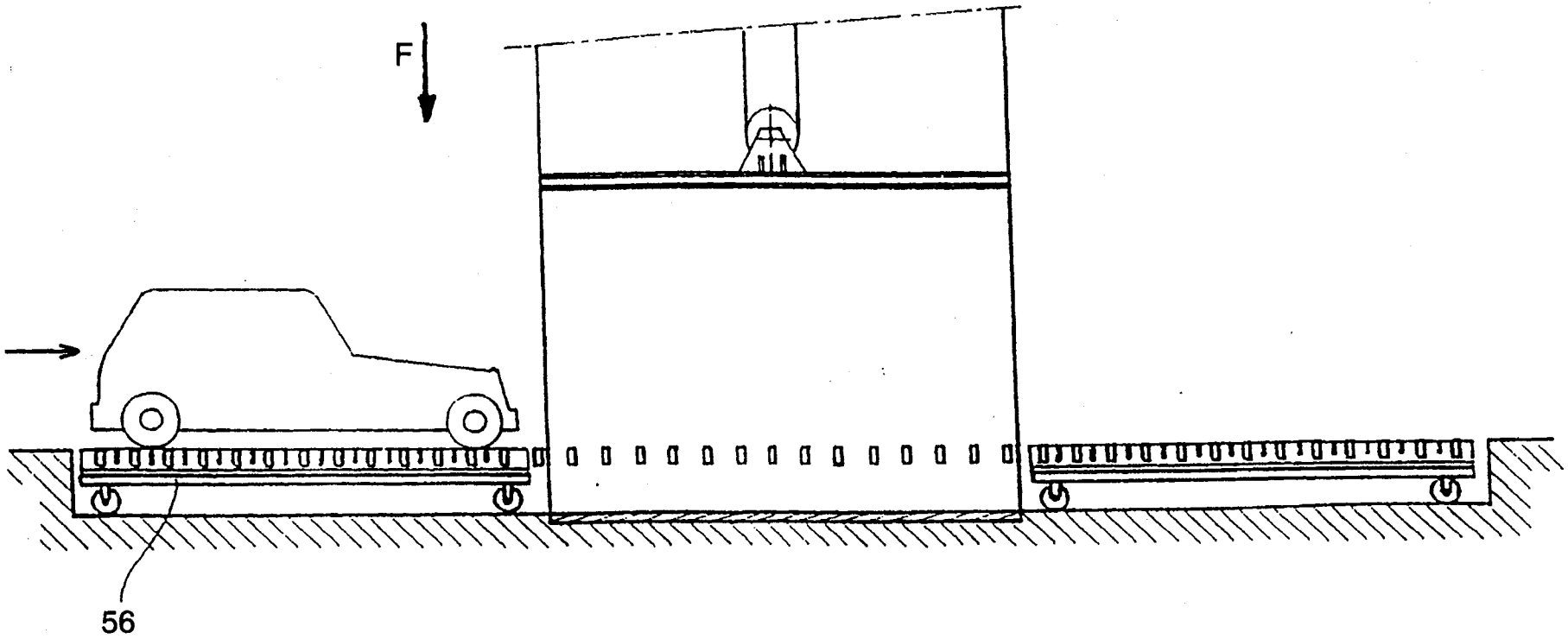
FIGS. 17, 18 and 19 are side views of the loading and unloading area shown in FIG. 16 showing the various process steps.
Figure 18:
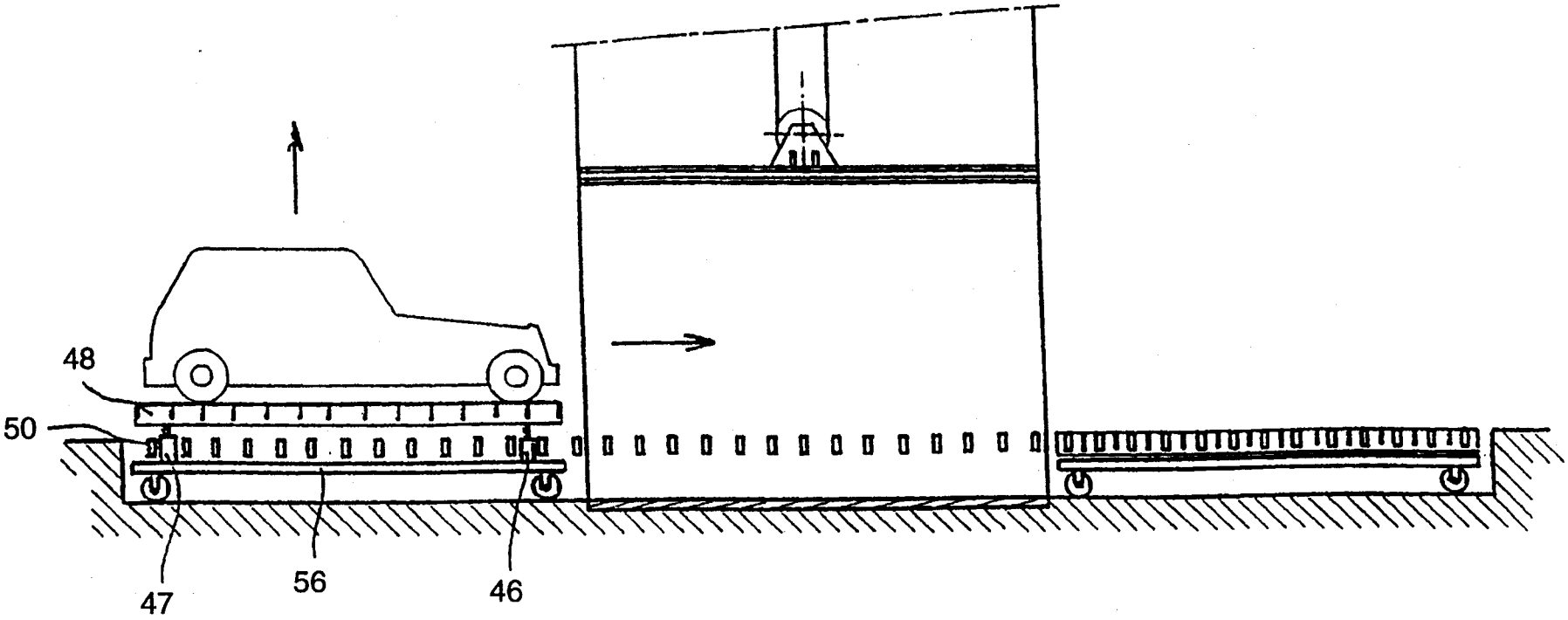
Figure 19:
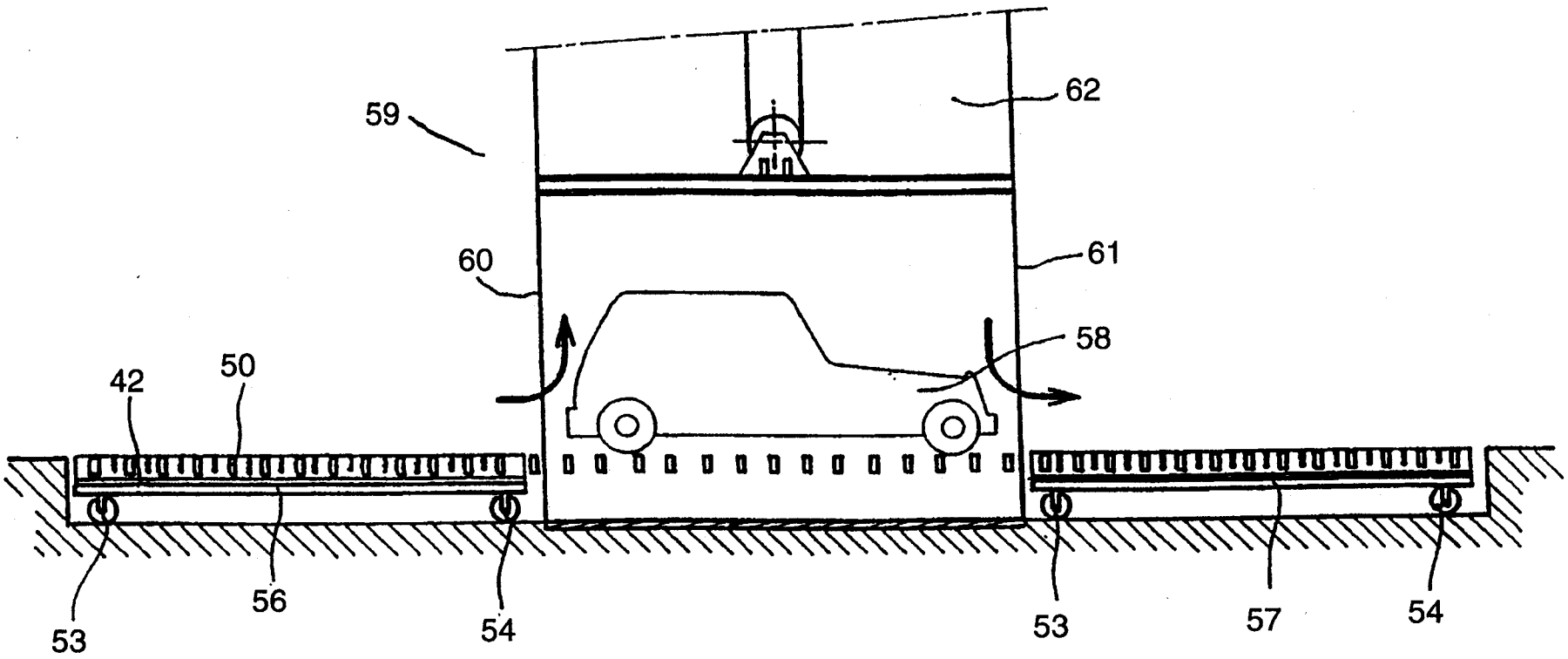

FIGS. 14 and 15 show another embodiment of a trolley 40 according to the invention.

Trolley 40 comprises a frame 41 at its bottom part, and a mobile platform 42 at its top part. Frame 41 is equipped with four stabilizing wheels 51, 52, 53, and 54 mounted as loose wheels. One of the two cross-beams 55 of the frame has a propelling wheel 43 ensuring stand-alone propelling of trolley 40. Jacks 44, 45, 46, and 47 allow upward or downward motion of mobile platform 42. Mobile platform 42 comprises a longitudinal beam 48 from which extend on opposite sides, a rack 49, 50 of a width and a length corresponding to those of racks 29 of storage cells 1.

One of the advantages of this embodiment of trolley 40 resides in propelling wheel 43. Thus, when trolley 40 backs up in a storage cell 1, propelling wheel 43, which can act as a traction wheel and is placed in the middle of a front cross-beam 55 of trolley 40, hardly enters the storage cell. Only stabilizing wheels 51, 53, 53, and 54, on each side of trolley 40, fully enter on each side of a storage cell. To this end, the storage cell features on its longitudinal sides a U-shaped, or similar piece, that stabilizing wheels 51, 52, 53 and 54 can circulate on. Thus, the floor surface can be diminished by 75-percent in the parking installation, reducing manufacturing cost, in particular, for containers.

FIGS. 16, 17, 18, and 19 show schematics of trolleys 56 and 57 which can load and unload a vehicle 58. Trolleys 56 and 57 are equipped with jacks allowing vertical movement of mobile platform 49. Elevator 59 is equipped with two access doors 60 and 61, and are placed in elevator shaft 62.

Figure 22:
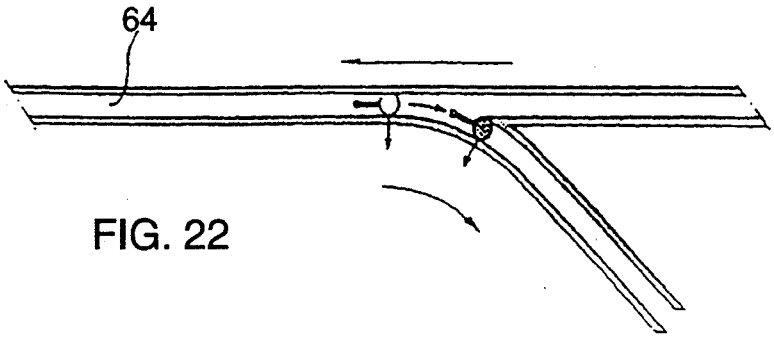
FIG. 22 is a view of a guiding groove showing the incoming motion of a trolley and the backward motion of a trolley toward a storage cell.
Figure 21:
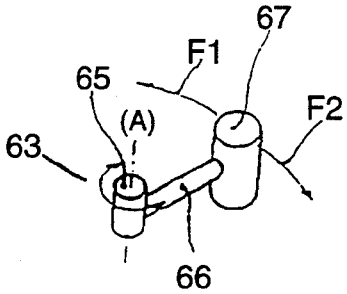
FIG. 21 is a perspective view of the switching means.
Figure 20:
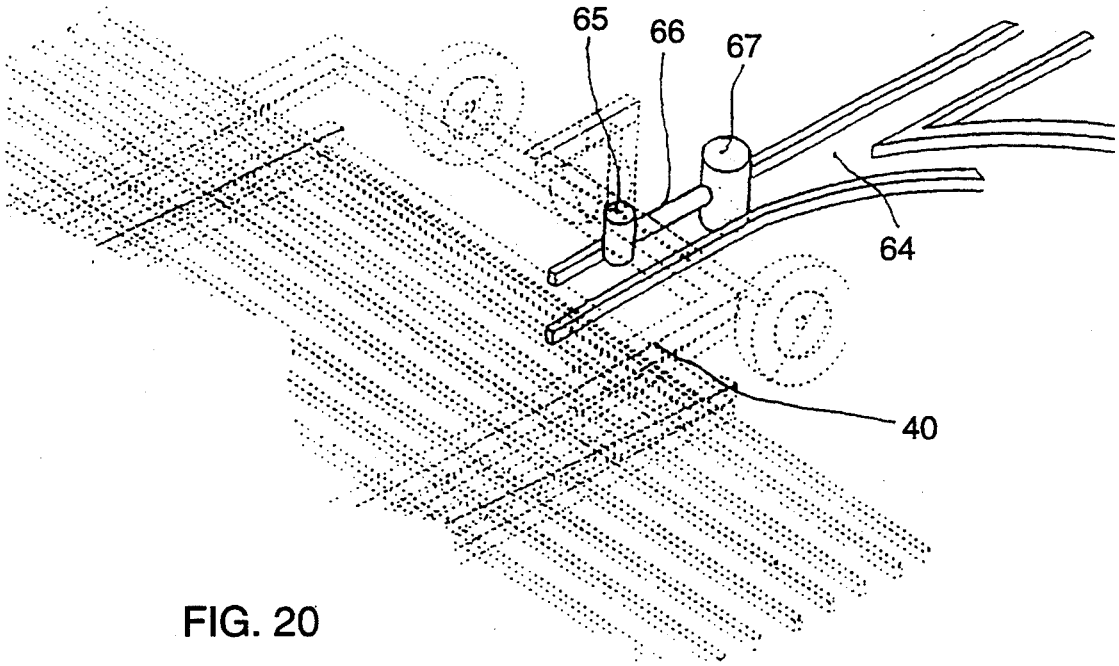
FIG. 20 is a partial perspective view of the trolley with its switching means.
Figure 23:
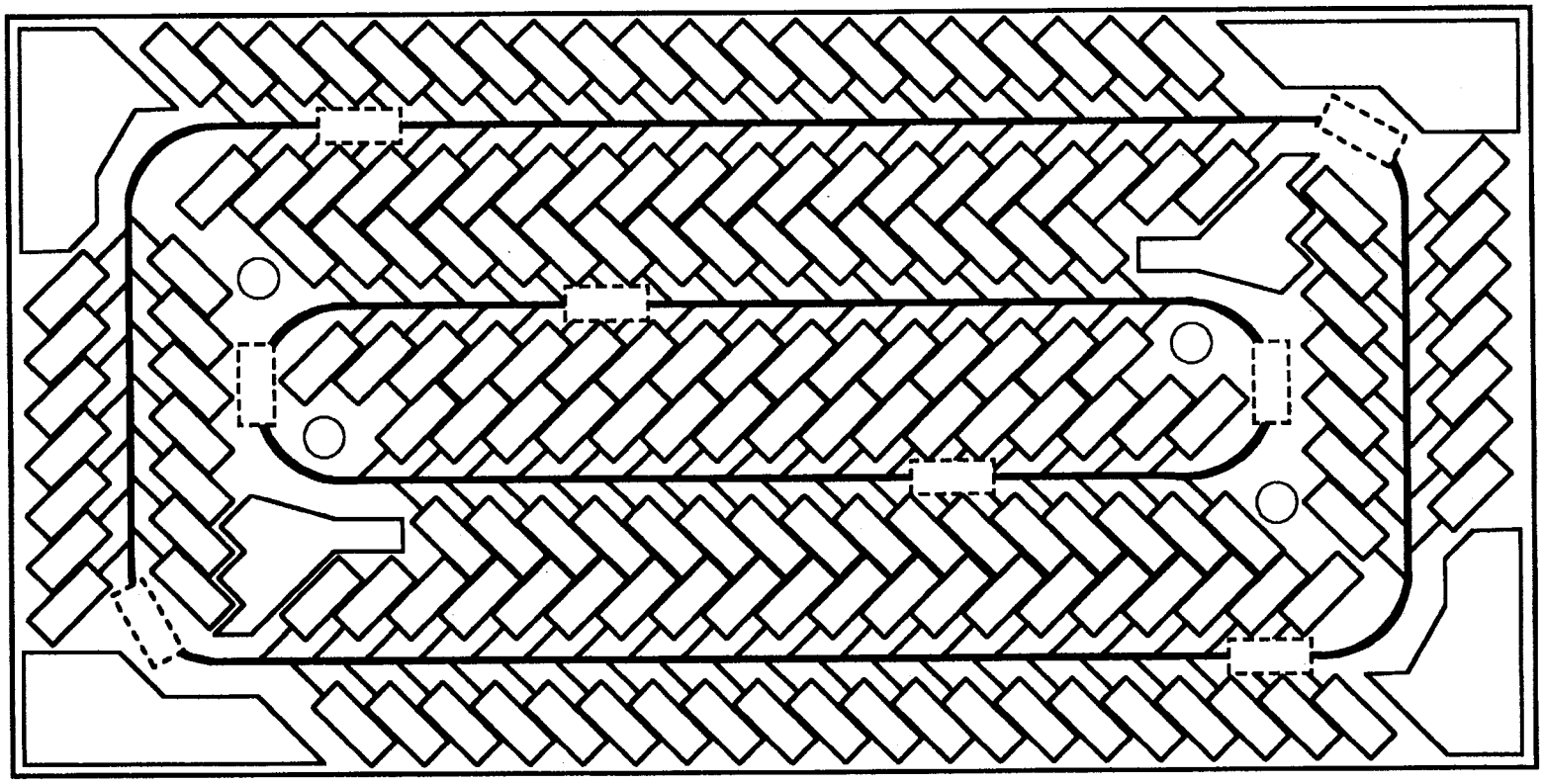
FIG. 23 is a plan view of a parking installation showing an inner traffic runway and an outer traffic runway allowing intermixing of the storage cells in a herring-bone pattern fashion.

FIGS. 20, 21 and 22 detail a guiding or shifting means 63. Guiding means 63 guides the trolley 40 in track 64, and is made of three pieces that are tied together. An axis 65 is mounted on trolley 40 and can oscillate with its arm 66 at the extremity of which is a guiding cam 67.

Rotation of the guiding means according to arrows F1 or F2 (FIG. 21) (i.e., to the right or to the left), is ensured, for example, by an electrical motor (not shown).

While the exemplary preferred embodiments of the present invention are described herein with particularity, those having normal skill in the art will recognize various changes, modifications, additions and applications other than those specifically mentioned herein without departing from the spirit of this invention.

What is claimed is:

1. An installation for storing objects, such as cars, comprising in combination:

a central managing unit;

an endless-shaped runway (5) having two longitudinal traffic alleys (6);

object storage cells (1) on both sides of each traffic alley (6) so that storage cell rows in between said traffic alleys are juxtaposed;

at least one trolley (4), comprising a frame (16) on wheels (18) and having trolley propelling means (15);

guiding means (8–9,20, 22, 23, 24), and switching means (10, 14), to allow said trolley to circulate along said runway (5), and to enter a storage cell (1); and each said trolley being also equipped with loading and unloading means (25, 28) to allow the lifting and the laying of an object when said trolley (4) sits inside a storage cell (1), said loading and unloading means (25, 28) cooperating with two fixed longitudinal racks (29) facing each other and each having horizontal fixed parallel bars placed at intervals, said racks being arranged so as to leave a central empty space in between the tips of said bars, all being managed by said central managing unit and being capable of controlling motion of the trolley (4) and said loading and unloading means (25–28).

2. The installation of claim 1 including:

at least two superimposed object storage levels; and at least one elevator (2, 3) travelling between a loading and/or unloading area for each storage level, so as to serve said levels, each of said elevators (2, 3) being arranged to cover an area of one storage cell (1), and allow an object to be lifted or laid when said trolley (4) sits inside the elevator (2, 3), each elevator having two fixed longitudinal racks (29) facing each other, each rack having horizontal fixed parallel bars placed at intervals, said racks being arranged so as to provide a central empty space in between the tips of said bars.

3. The installation of claim 2 wherein said storage cells (1) are placed in herring-bone pattern from said longitudinal traffic alleys (6).

4. The installation of claim 2 including the guiding means (8–9, 20, 22, 23, 24) and the switching means (10, 14) for a trolley (4) to allow a trolley to enter said storage cells (1) and said elevator (2, 3).

5. The installation of claim 2 wherein said elevator (2, 3) includes a mobile floor-board (30) equipped with openings for receiving the horizontal bars of said fixed racks (29), and means (31) for vertically shifting said floor-board between the high position where it is in the same plane as that of said racks (29), and a low position where it is under said racks (29) so as to align with said runway (5).

6. The installation of claim 1 wherein said storage cells (1) are placed in herring-bone pattern from said longitudinal traffic alleys (6).

7. The installation of claim 1 wherein said loading and unloading means (25–28) comprises:

a mobile stand (25) carried by a frame (16) of said trolley (4) and comprising a central longitudinal structure (27) of a width smaller than that of said central empty space between said two fixed racks (29), and two series of horizontally parallel bars (28) placed at intervals perpendicular to, and on each side of, said central longitudinal structure; and means (26) for vertically shifting said mobile stand (25), when a trolley (4) sits in a storage cell (1) or an elevator (2, 3) from a lower position where said mobile stand is underneath said fixed racks (29), to a higher position where said mobile stand is above said fixed racks (29).

8. The installation of claim 7 wherein said means for vertically shifting said mobile stand comprise vertical jacks (26) fixed to said frame (16) of a trolley (4).

9. The installation of claim 1 wherein:

said trolley (4) wheel comprise four wheels (18) joined two-by-two by two axles (17) through pivots (19), each trolley 4 having the frame (16) supported by said four wheels (18) and equipped with stand-alone propelling means (15); and guiding means for said trolley (4) comprising main guiding groove (8) longitudinally in said runways (5), and for a trolley, two guiding rollers (22) fitting and sliding within said main guiding groove for actuating said pivots (19) of two wheels joined by the same axle (17) through steering tie rods (21).

10. The installation of claim 9 wherein secondary guiding grooves (9) are associated with said storage cells and intersect with said main guiding groove (8) to allow a trolley (4) to enter a storage cell (1) and an elevator (2, 3) by means of operation of switching means (10, 14) placed at each intersection of said main guiding groove and each secondary guiding groove.

11. The installation of claim 10 wherein said switching means (10, 14) comprises at each said intersection, a piston (10) placed horizontally in a cavity (11) of said runway (5), said cavity opening into said main guiding groove (8), said piston being connected to operate a rod (10B) and a switching shoe (13) having a front face (13A) shaped to guide the trolley (4) toward a secondary guiding groove (9), said switching shoe having two states: a drawn-in state when said shoe (13) is out of said main guiding groove (8), and a spread-out state when said show resides within said main guiding groove.

12. The installation of claim 1 including:

detection means for stopping a trolley (4) when it has passed an intersection corresponding to a selected storage cell or a selected elevator (2, 3); and said central managing unit being programmed to actuate said switching means (10–14) at a selected intersection and to control motion of a trolley (4).

13. The installation of claim 1 wherein said trolley (40) frame comprises a top frame having two cross-beams (41), a bottom mobile platform (42), said frame (41) being equipped with four stabilizing wheels (51, 52, 53, 54) mounted as loose wheels; one of said two frame cross-beams having a propelling wheel (43) ensuring stand-alone propelling of said trolley (40).

14. The installation of claim 13 wherein a guiding means (63) guides the trolley (40) and is made up of three pieces tied together; an axis (65) mounted on a trolley (40), said axis providing oscillation of an arm (66) at an extremity of which is provided by a motor.

* * * * *